United States Patent [19]

Moffat

[11] 3,944,789

[45] Mar. 16, 1976

[54] PERCENT CALCULATOR

[76] Inventor: Jon L. Moffat, 1236 - 73rd Ave. SW., Calgary, Alberta, Canada

[22] Filed: Mar. 9, 1973

[21] Appl. No.: 339,840

[52] U.S. Cl. ..... 235/78 M; 235/88 M; 235/84

[51] Int. Cl.[2] ..... G06C 27/00

[58] Field of Search..... 35/31 A, 31 C; 235/77, 235/78, 83, 84, 115–116, 122, 61 B, 61 C

[56] References Cited

UNITED STATES PATENTS

| | | | |
|---|---|---|---|
| 1,423,896 | 7/1922 | Wickoff | 235/84 |
| 1,609,571 | 10/1926 | Olson | 235/61 B |
| 2,358,856 | 9/1944 | Galbe | 235/83 |
| 2,358,856 | 3/1940 | Gunning | 235/88 |
| 2,494,175 | 1/1950 | Griesbaum | 235/84 |
| 2,544,224 | 3/1951 | Hachmuth | 235/78 |
| 2,996,246 | 8/1961 | Swanson | 235/83 |
| 3,095,144 | 6/1963 | Mims | 235/77 |

FOREIGN PATENTS OR APPLICATIONS

| | | | |
|---|---|---|---|
| 1,926,715 | 1971 | Germany | 235/78 |
| 463,696 | 1951 | Italy | 235/78 |

*Primary Examiner*—George H. Miller, Jr.
*Assistant Examiner*—Vit W. Miska
*Attorney, Agent, or Firm*—Cushman, Darby & Cushman

[57] ABSTRACT

This invention relates to a manually operable calculator; used to determine percent scores and to weight tests, comprised of a circular disc having a centrally pivoted rule. The disc has an outer periphery of numerals indicating per cent scores, the radii of numerals below 100 per cent indicating perfect scores, the radii of per cents other than one hundred indicating raw scores, and numerals on the rule corresponding to numerals on the radii below 100 per cent.

6 Claims, 5 Drawing Figures

PERCENT CALCULATOR

Figure 1:
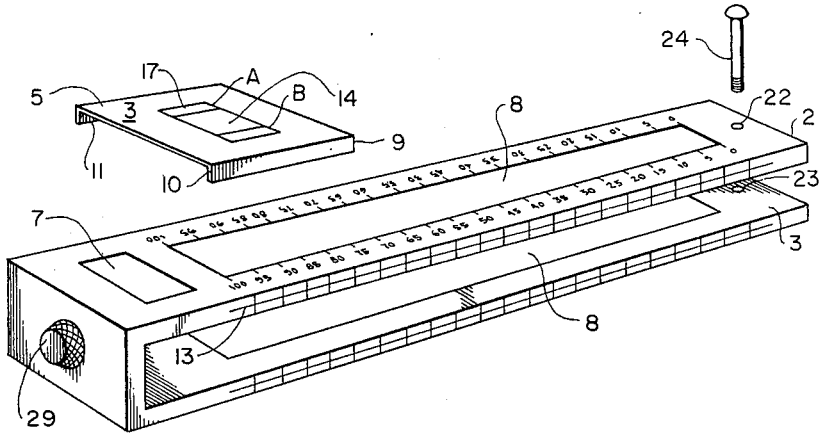

This invention relates to a manually operable calculator which can be used to convert ratios to per cents or to weight scores.

It is common practice in preparing tests and examinations for the examiner to set questions and answer these questions himself. Once the questions are answered the examiner determines the number of issues which should be discovered by the student and the number of elements which should be discussed with respect to each issue. The examiner will then allot a certain number of points for the issues found by the student and further points for the elements developed with respect to each issue. When the examiner has completed his determination he will add the points for each question to arrive at a perfect raw score. The perfect raw score will vary from test to test, and may be for example, 35, 95, 125, 150, 250. When the examiner corrects the papers he will obtain a raw test score which will be equal to or less than the perfect raw score. The calculator of the instant invention enables the examiner to quickly and easily transpose the relationship of the test raw score to any perfect raw score between 0 and 300 and arrive at the resulting per cent score.

In weighting of various tests the student will have achieved a number of per cent scores. The various tests will be attributed a chosen weight per cent, the total of the weight per cent being 100 per cent. The calculator will enable the operator to determine the weighted score which is the ratio of the per cent score to the chosen weight per cent.

Figure 2:
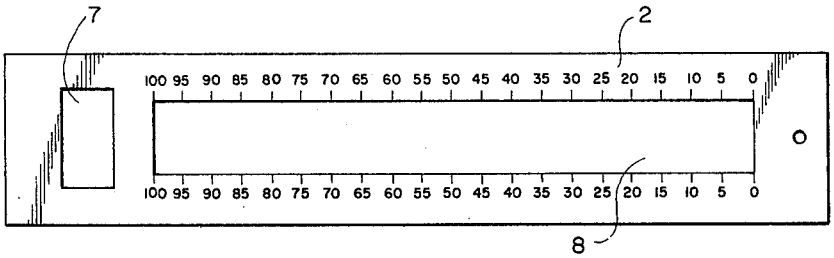
Figure 3:
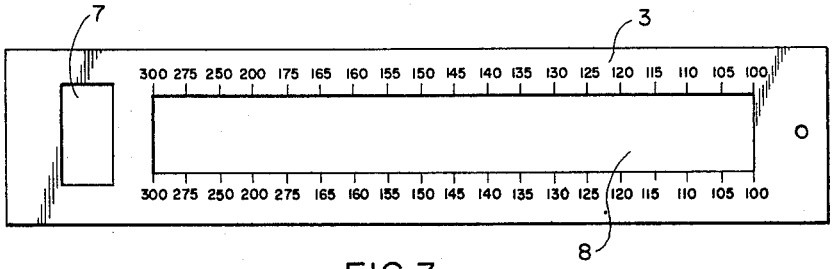
Figure 4:
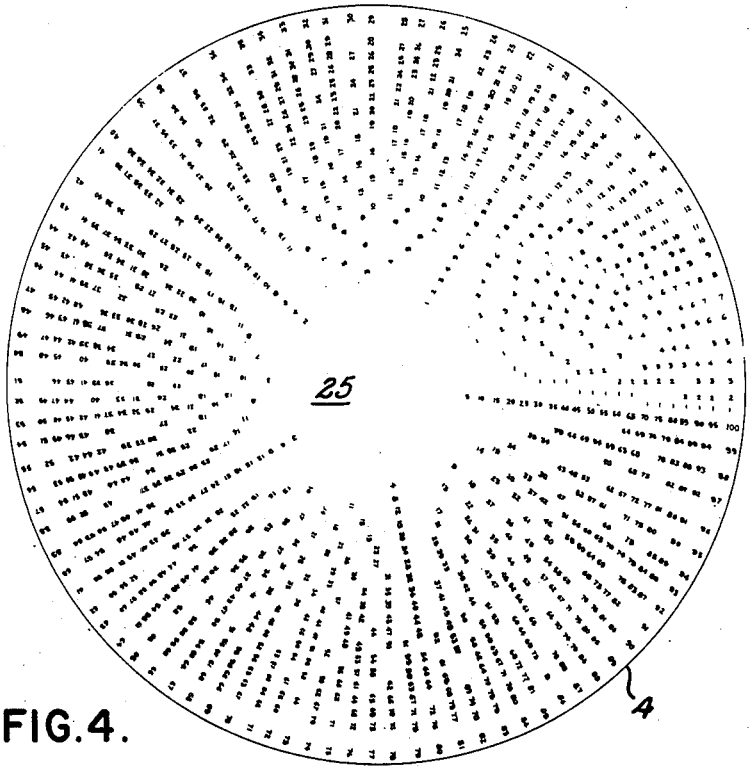
Figure 5:
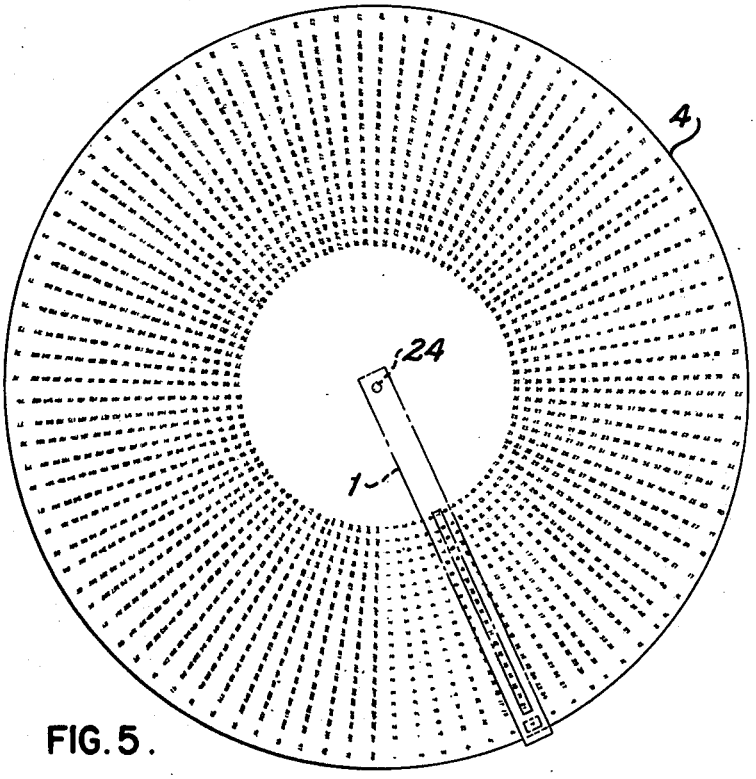

In the drawings which illustrate embodiments of the invention:

FIG. 1 is a persepctive view of the calculator
FIG. 2 is a plan view of the calculator
FIG. 3 is a bottom view of the calculator
FIG. 4 is a plan view of the top of the disc
FIG. 5 is a plan view of the bottom of the disc The calculator as illustrated in FIG. 1 is comprised of a rule 1, having legs 2, and 3 respectively, a disc 4 and slide 5.

The rule 1 as illustrated in FIG. 1 is in the shape of a U having elongated legs 2 and 3 which are integrally connected to the relatively shorter base 6. Both legs 2 and 3 include an aperture 7 near the base 6 and an elongated aperture 8 running substantially seven-eighths of the length of legs 2 and 3 respectively. One leg 2 has marked on its upper surface on either side of elongated aperture 8 a scale marked into 20 divisions from 0 to 100. The other leg 3 of the rule includes on either side of its elongated aperture 8 a scale marked into divisions from 105 to 300. A slide 5 is provided to run on each of legs 2 and 3 of rule 1. The slide 5 is comprised of a channel 9 having short flanges 10 and 11. Flange 10 has a short inwardly directed edge 12, adapted to fit into a groove 13 on one side of legs 2 and 3 of rule 1, the other flange 11 of slide 5 includes a spring leaf which rides against the side of leg 2 or 3 opposite the groove 13 which maintains flanges 10 in the groove of legs 2 or 3 respectively. The centre of slide 5 includes a cut out portion 14 of width 15 slightly greater than the width of elongated aperture 8. A magnifying glass 16 is insertable in cut out portion 14. The magnifying glass 16 includes a longitudinal hair 17 on the longitudinal centerline 18. The width 15 of cut out portion 14 is such that the scales marked on the sides of respective longitudinal apertures 8 are clearly visible through the upper and lower edges of magnifying glass 16. The small aperture 7 near base 6 also contains a magnifying glass 21.

Each of legs 2 and 3 include apertures 22 and 23 on the centerline of each of legs 2 and 3 respectively at the end of the legs 2 and 3 opposite the base 6. The apertures 22 and 23 are adapted to receive a pin 24 which forms the axis upon which disc 4 is mounted. As seen in FIGS. 4 and 5 the disc 4 includes a centering hole 25 through which pin 24 is inserted to fasten the disc 4 to rule 1. The base 6 (FIG. 1) includes a threaded aperture 27 adapted to receive a threaded bolt 28 having head 29 which is biased outwardly by spring 30 acting between head 29 and the outside of base 6. When bolt 28 is threaded inwardly it retains disc 4 in a fixed position for reading the calculator.

As seen in FIG. 4 which illustrates one side of the disc 4, the periphery of the disc 4 includes numbers from 1 to 100 which are per cents. The radii of the discs extending inwardly from 100 are divided into 20 numerals in units of 5 being 0,5,10,15,20,25, 30,35,40,45,50,55,60,65,70,75,80,85,90, and 95. These numbers indicate the perfect raw score. The remaining radii extending inwardly from 99% to 1% are test raw scores.

As seen in FIG. 5 which illustrates the other side of the disc 4, the periphery of the disc 4 includes numbers from 1 to 100 which are per cents. The radii of the disc extending inwardly from 100 per cent includes the perfect raw scores 300,275,250,225,175, 165,160,155,150,145,140,135,130,125,120,115,110 and 105. The radii extending inwardly from 1% to 99% contain test raw scores.

The numbering sequences on each side of the disc are systematically arranged on 20 circumferences. Each circumference includes in the radii below 100% any chosen perfect raw score. For example, if a perfect raw score is 75 and a student obtains a test raw score of 21 and one is to obtain a per cent test score the following steps are taken:

The sliding window is moved along the side of the rule having 75 thereon until the hair of the sliding window intersects the number 75. The disc is then turned until the test raw score 21 appears in elongated aperture in the rule below the hair of the sliding window. The per cent score of 28% can then be read in the small aperture near the base of the rule.

If the examiner wishes to convert fractions of marks to per cent of test score, this can be done. For example, if a student receives a test raw score of 21 ¼ out of a perfect raw score of 60, the following steps are to be followed:

1. set the hair on sliding window to 60 on the rule
2. rotate the disc and stop at the test raw score of 21, showing in the long aperture of rule
3. look at the per cent window and note the per cent i.e.: 35%
4. rotate the disc to the next highest number which is 22 and note 37% in the per cent window
5. subtract the two per cents and multiply by ¼ i.e.: $\frac{1}{4}(37-35)=\frac{1}{4}(2)=\frac{1}{2}\%$
6. Thus, the student has a per cent score of $35+\frac{1}{2}=35\frac{1}{2}\%$. Calculated by long hand the student would have a percent score of 35.4 or an error of 00.1% in favour of the student Similarly if a student had a test raw score of 21.6 out of a perfect raw score of 60, then steps 1 to 5 (above)

would be repeated except instead of multiplying the difference (2) by ¼, it would be multiplied by 0.6 or $0.6 \times 2 = 1.2$. Thus the student's per cent score would be $35 + 1.2 = 36.2$. In this case, the error in favour of the student would be 0.2%. Though there may be discrepancies while interpolating, this is not considered serious, as in most cases, it will not exceed 3/10 of a per cent, and most examiners round out their exams to the nearest whole per cent.

When an examiner has a test raw score which cannot be found on the disc, interpolation should be used. For example, suppose an exam has a perfect raw score of 300. This means that a raw score of three points is required for each one per cent. For a test raw score of 271 out of 300, the following procedure should be used:

1. set the hair on the sliding window to 300 on the rule
2. rotate the disc to the numbers which bracket the student's test raw score. In this case 270, and 273
3. subtract the two, $273 - 270 = 3$
4. take a per cent of 1 to $3 = 00.33$
5. add 00.33 to the per cent of $270 = 90 + 0.33 = 90.33\%$ This is normally rounded off to 90%.

As mentioned earlier the calculator can also be used for weighting. Scores are weighted by:

1. deciding on the desired weightings
2. setting the sliding window at the number on the rule corresponding to the selected weightings
3. rotate the disc until the student's per cent score appears in the per cent window
4. note the score found in the long aperture below the hair of the sliding window
5. repeat 1 to 4 for different weightings.

EXAMPLE

Per cents from three tests:

TEST 1 — 40%; TEST 2 — 75%; TEST 3 — 90%

The examiner wishes to weight each test score as follows: test 1 — 30%; test 2 — 25%; test 3 — 45%

1. set the sliding window to 30 on the rule
2. rotate the disc until 40 appears in the PER CENT window
3. note the weighting which appears in the long aperture below the hair of the sliding window which is 12
4. repeat steps 1 to 3 for test No. 2, setting the sliding window at 25 on the rule
5. repeat steps 1 to 3 for test No. 3, setting the sliding window at 45 on the rule, the results you end up with are as follows:

| | | | |
|---|---|---|---|
| 6. | test 1 — 40%, | weighting of 30% | = 12 |
| 7. | test 2 — 75%, | weighting of 25% | = 19 |
| 8. | test 3 — 90%, | weighting of 45% | = 41 |
| | 205% | 100% | 72% |

Final weighted score is 72%. By long hand, each score of 6, 7 and 8 would be calculated as follows:

| | |
|---|---|
| test 1 30% of 40 = | 12 |
| test 2 25% of 75 = | 19 |
| test 3 45% of 90 = | 41 |
| | 72% |

While a preferred embodiment of this invention has been illustrated it is obvious that other embodiments which incorporate the principles of this invention can be designed. Such of these modified embodiments as incorporate the principles of this invention are to be considered as included in the hereafter appended claims unless these claims by their language expressly state otherwise.

I claim:

1. A manually operable calculator to calculate per cent scores and to weight test scores comprised of a circular disc, a rule on either side of said disc centrally pivotally fastened to said disc to provide relative movement of three hundred and sixty degrees between said rule and said disc, each side of said disc including an outer circumference of numerals indicating from one to one hundred percent, the radii of the numeral extending inwardly from one hundred per cent comprising a series of numerals representing perfect raw scores, a series of interior circumferences of numerals each corresponding to one perfect raw score, each of said interior circumferences comprising a series of numerals representing test raw scores with one test raw score for each per cent on the outer circumference, each said test raw score on said interior circumference being the numerator, the perfect raw score on the same circumference being the denominator, the percentage score on the outer circumference of the radii of each such test raw score representing the percentage of the test raw score to the perfect raw score, numbers on the rule on each side of the disc representing various perfect scores.

2. The manually operable calculator of claim 1 wherein the rule is elongated U shape comprised of two legs connected by a short base, means provided for pivotally fastening the disc through its centre between the open legs of the rule by a pivot means situated substantially near the end of the open legs.

3. The manually operable calculator of claim 1 wherein the calculator will provide a per cent of any test raw score to perfect raw scores up to 300.

4. The manually operable calculator of claim 2 wherein each leg of the rule includes an aperture near the base of the rule corresponding to the outer circumference of numerals on either side of the disc, and an elongated aperture in the rule which will show one radii of numerals on either side of the disc.

5. The manually operable calculator of claim 4 wherein each rule is adapted to receive a sliding window moveable up and down said rule to a desired position.

6. A manually operable calculator comprising a manipulable array of the relation which individuals of a series of ratios representing actual raw scores compared with perfect raw scores bears to per cents, comprising:

a disk having a series of per cents arranged on a plurality of angularly succeeding, equal length radii of an imaginary circle on the disk;

a rule pivotally pinned to the disk at the origin of said imaginary cicle, the rule bearing a series of perfect raw scores, arranged in radiating line and a scale graduating the series along a radiating edge of the rule;

a marker slidable along the rule to indicate a selection of the perfect raw score;

a marker fixed on the rule and arranged to align with each of the individuals of said series of per cents, in consequence of pivotal movement of the rule with respect to the disk;

a plurality of angularly spaced, individually radiating series of actual raw scores arranged on the disk in the following relationship:

a. when the rule is angularly positioned with the fixed marker aligned with any particular individual of the series of percents, b. and the slidable marker indicates a particular perfect raw score, c. the graduated scale lies angularly beside one among said plurality of angularly spaced, individually radiating series of actual raw scores arranged on the disk, and d. the graduation on said graduation scale corresponding to the radius to which the slidable marker has been slid in (b) indicates the individual in said one series of (c) which most nearly equates to the actual raw score and multiplied by 100 equals the individual percent with which the fixed marker is aligned in (a), whereby when a particular raw score is to be converted to a percent score, the slidable marker may be set to align with the perfect raw score on the rule, and the rule may be pivoted until the said graduation of (d) indicates said particular raw score, whereupon the fixed marker will be found to be aligned with the percent corresponding to the ratio of the particular raw score to the perfect raw score.

* * * * *